US005317121A

United States Patent [19]

Katayama et al.

[11] Patent Number: 5,317,121

[45] Date of Patent: May 31, 1994

[54] INDUCTION HEATING APPARATUS HAVING OPENABLE AND CLOSABLE COIL

[75] Inventors: Keiichi Katayama; Mitsuo Kato; Kazuya Tsurusaki; Mikio Hanamoto; Kazumasa Mihara, all of Hiroshima; Takatoshi Eguchi, Tokyo, all of Japan

[73] Assignee: Mitsubishi Jukogyo Kabushiki Kaisha, Tokyo, Japan

[21] Appl. No.: 947,836

[22] Filed: Sep. 21, 1992

[51] Int. Cl.[5] ..... H05B 6/44

[52] U.S. Cl. ..... 219/672; 219/675

[58] Field of Search ..... 219/10.79, 10.75, 10.69, 219/10.71, 10.57, 10.61 R

[56] References Cited

U.S. PATENT DOCUMENTS

| | | | |
|---|---|---|---|
| 2,052,010 | 8/1936 | Bailey | 219/10.79 |
| 3,301,991 | 1/1967 | Geisel et al. | 219/10.79 |
| 3,431,382 | 3/1969 | Esche et al. | 219/10.79 |
| 3,444,346 | 5/1969 | Russell et al. | 219/10.74 |
| 3,531,612 | 9/1970 | Viart | 219/10.79 |
| 3,619,540 | 11/1971 | Soworowski | 219/10.71 |
| 3,731,040 | 5/1973 | Kasper | 219/10.79 |
| 4,258,241 | 3/1981 | Soworowski | 219/10.71 |
| 4,695,712 | 9/1987 | Busch | 219/10.79 |

FOREIGN PATENT DOCUMENTS

| | | |
|---|---|---|
| 365027 | 12/1981 | Fed. Rep. of Germany . |
| 3833355 | 4/1989 | Fed. Rep. of Germany . |
| 977154 | 3/1951 | France . |
| 1202085 | 1/1960 | France . |

*Primary Examiner*—Philip H. Leung

*Attorney, Agent, or Firm*—Wenderoth, Lind & Ponack

[57] ABSTRACT

An induction heating apparatus has a coil or coils which can be opened without using electrical contacts. One continuous electric current passageway is formed by a first coil section, a second coil section, a first connecting conductor and a second connecting conductor. By feeding electric power to this electric current passageway and passing an object through a space at the central portion of the coil sections, the object is induction heated. A gap is provided between the first connecting conductor and the second connecting conductor, or the respective connecting conductors can be opened and closed relative to one another to vary the size of the space therebetween. The object to be heated is carried into the space at the central portion of the coil and is carried out therefrom through the gap or the space between the conductors.

3 Claims, 7 Drawing Sheets

INDUCTION HEATING APPARATUS HAVING OPENABLE AND CLOSABLE COIL

BACKGROUND OF THE INVENTION

1. Field of the Invention

The present invention relates to an induction heating apparatus, and more particularly, to the structure of an induction heating coil of an induction heating apparatus for continuously heating a conductive object.

2. Description of the Prior Art

One example of a continuous induction heating apparatus for heating a plated steel sheet in the prior art is shown in FIGS. 5 and 6. As shown in FIG. 5, a plated steel sheet 1 is continuously carried into an induction heating apparatus 3 as guided by guide members 2. Within the induction heating apparatus 3 is a solenoid type of induction heating coil 4 as shown in FIG. 6. The plated steel sheet 1 is conveyed as surrounded helically by the induction heating coil 4, i.e. passes through a central space of the induction heating coil 4. The induction heating coil 4 has a heat-insulating dielectric material at its outermost layer, and by passing an electric current through the induction heating coil 4, the plated steel sheet can be inductively heated.

The amount of electric power to be fed to the induction heating coil 4 depends upon the extent of a temperature rise and a production rate (a steel sheet conveying speed) required for the plated steel sheet 1.

Since the plated steel sheet 1 is to be heated while passing through the space at central portion of the induction heating coil 4, when a leading end portion of the plated steel sheet 1 is to be introduced into the heating apparatus 3, a leading wire is connected to the leading end of the plated steel sheet, then this leading wire is first fed through the induction heating coil 4, and subsequently the plated steel sheet 1 is led by the wire through the induction heating coil 4.

The heating apparatus 3 in the prior art shown in FIGS. 5 and 6 has the following shortcomings.

(1) Because of the fact that a solenoid type of induction heating coil 4 is employed, the object to be heated must be led into the apparatus by a leading wire. Therefore, labor is necessary for initially leading the plated steel sheet 1 into or from the heating apparatus 3.

(2) Since the induction heating coil 4 has a closed structure (spiral shape), heat-insulating dielectric material on the inner surface of the coil (on the surface facing the plated steel sheet 1) is impossible to maintain and inspect.

An induction heating apparatus obviating the above-mentioned shortcomings (1) and (2) has been developed. One example of such an apparatus will be explained with reference to FIG. 7. In this heating apparatus 10, while a solenoid type of coil 11 is employed, conductors 11*a* forming a part of the coil 11 are separable from the remainder of the coil. The conductors 11*a* can be opened and closed by means of a revolving mechanism, and at the time of closure, the opposite ends of the conductors 11*a* are connected via knife-edge type of contacts 12 to the other portions of the coil 11 to form a loop. When the loop is formed, electrical power is fed from a power supply section 13 to the coil 11, and an object to be heated is passed through a space at the central portion of the coil 11, whereby induction heating can be effected. It is to be noted that the contact 12 is made to have a sufficient connector capacity for allowing passage of a high-frequency current through the coil 11 without any trouble.

In this heating apparatus 10, before an object to be heated is made to pass through the apparatus for the first time, the conductors 11*a* are opened up to the positions depicted by dotted lines in FIG. 7. Then the heating apparatus 10 is moved while the object to be heated is kept stationary, and the object to be heated is set in the space at the central portion of the coil. In addition, if the conductors 11*a* are kept opened, the inner surface side of the coil 11 can be easily inspected.

However, the heating apparatus shown in FIG. 7 has the following shortcomings.

(1) Since a high current (1000–2000A) at a high frequency (about 10 KHz) flows through the contacts 12, the contact surfaces when opening and closing the conductors are likely to become rough. In addition, because twice as many contacts 12 as the number of turns of the coil 11 are necessary, a miscentering may occur when a plurality of the contacts 12 open and close. For such reasons, reliability would be lowered if it is used for a long period.

(2) Because contacts 12 and a mechanism for opening and closing the conductors 11*a* are necessary, the equipment cost is high.

SUMMARY OF THE INVENTION

It is therefore one object of the present invention to provide an improved induction heating apparatus in which an object to be heated can be simply carried in and carried out of a coil without interrupting an electric current loop and without the use of contacts.

According to one embodiment of the present invention, there is provided an induction heating apparatus including a first coil section having at least one turn of coil which has a discontinuity at one location, and a second coil section having at least one turn of coil which has a discontinuity at one location, wherein one end of the turn of coil of the first coil section and one end of the turn of coil of the second coil section are electrically connected via a first connecting conductor, and the other end of the turn of coil of the first coil section and the other end of the turn of coil of the second coil section are electrically connected via a second connecting conductor, whereby one continuous electric current passageway is formed by the turns of the coil sections and the connecting conductors. Furthermore, a gap having a predetermined gap length is formed between the first connecting conductor and the second connecting conductor.

According to another embodiment of the present invention, there is provided an induction heating apparatus including a first coil section having at least one turn of coil which has a discontinuity at one location, and a second coil section having at least one turn of coil which has a discontinuity at one location, wherein one end of the turn of coil of the first coil section and one end of the turn of the coil of the second coil section are electrically connected via a first connecting conductor, and the other end of the turn of coil of the first coil section and the other end of the turn of coil of the second coil section are electrically connected via a second connecting conductor, whereby one continuous electric current passageway is formed by the turns of the coil sections and the connecting conductors. Furthermore, each turn of the coil has a flexible portion provided between the ends thereof so that the length of a gap between the first connecting conductor and the second connecting conductor can be varied.

In the induction heating apparatus according to the present invention, as shown in FIG. 1(*a*), an electric current fed from a high-frequency power supply 60 via a coil feeder section 70 flows through the route of [a turn of the first coil section 110]→[a first connecting conductor 130]→[a turn of the second coil section 120]→[a second connecting conductor 140]→[a turn of the first coil section]→. . . and then returns to the high-frequency power supply via the coil feeder section 70. At this time, induction heating can be effected by making an object to be heated pass through the space in the central portion of the coil. More particularly, the respective turns of the first coil section 110 generate magnetic fields directed in the same direction to heat the object to be heated, and the respective turns of the second coil section 120 generate magnetic fields directed in the same direction to heat the object to be heated.

Owing to the fact that a gap is formed between the first connecting conductor 130 and the second connecting conductor 140 or the length of a gap therebetween can be varied, an object to be heated can be set within the coil or it can be taken out of the coil through the gap.

When induction heating is to be effected, by reducing the gap between the first connecting conductor 130 and the second connecting conductor 140, the impedance at the connecting conductors is made small. Hence, a voltage drop at this portion becomes negligible. Therefore, the heating performance is degraded to only a very little extent.

As shown in FIG. 1(*b*), the first coil section 110 can have only one turn, and the second coil section 120 can also have only one turn.

The present invention has the advantages of (1) high reliability, and low cost because the apparatus does not require loop interruption and contacts, (2) facilitating the carrying-in and carrying-out of an object to be heated, as well as the maintenance and inspection of an inner surface of a coil because a gap is formed in the coil or the coil is openable and reduction in impedance associated with the gap owing to the fact that the direction of the current flowing through the first connecting conductor and the direction of the current flowing through the second connecting conductor are opposite to each other and the first and second connecting conductors are opposed to each other with a gap as small as possible being defined therebetween.

The above-mentioned and other objects, features and advantages of the present invention will become more apparent by referring to the following description of preferred embodiments of the present invention made in conjunction with the accompanying drawings.

BRIEF DESCRIPTION OF THE DRAWINGS

In the accompanying drawings:

FIG. 3(*c*) is a plan view of the second preferred embodiment;

DESCRIPTION OF THE PREFERRED EMBODIMENTS

In the following, a number of preferred embodiments of the present invention will be described in detail with reference to the accompanying drawings.

Figure 1A:
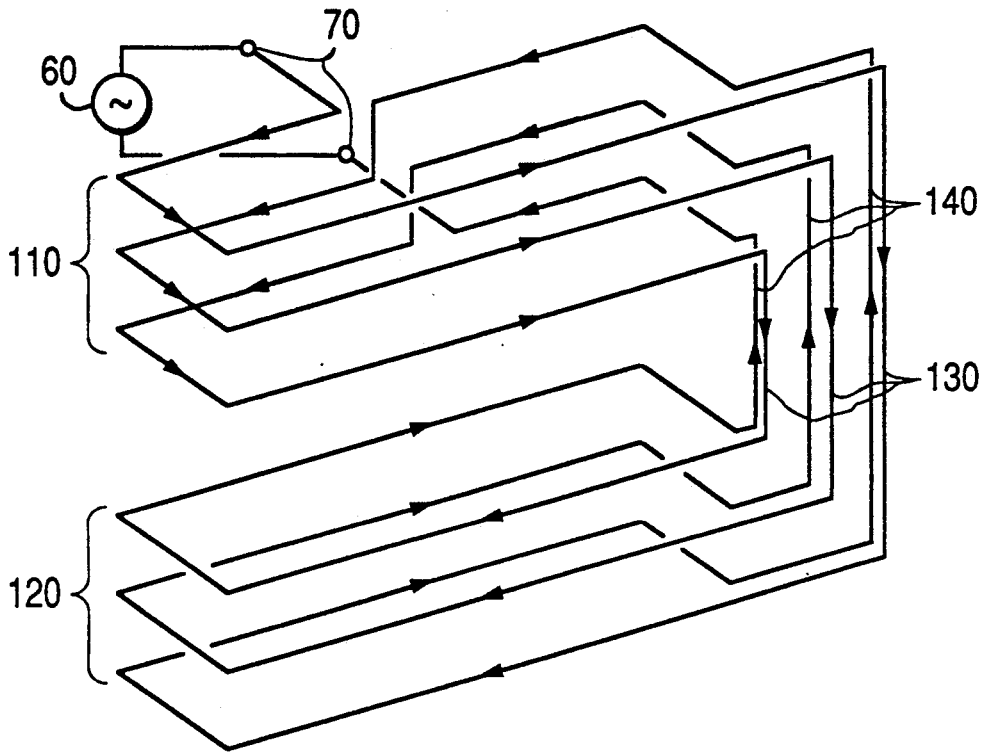
FIG. 1(*a*) and 1(*b*) are each a schematic view of the present invention.
Figure 1B:
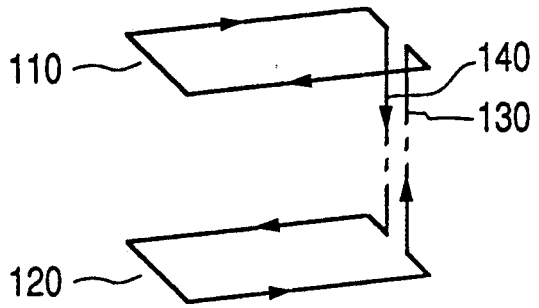
Figure 2:
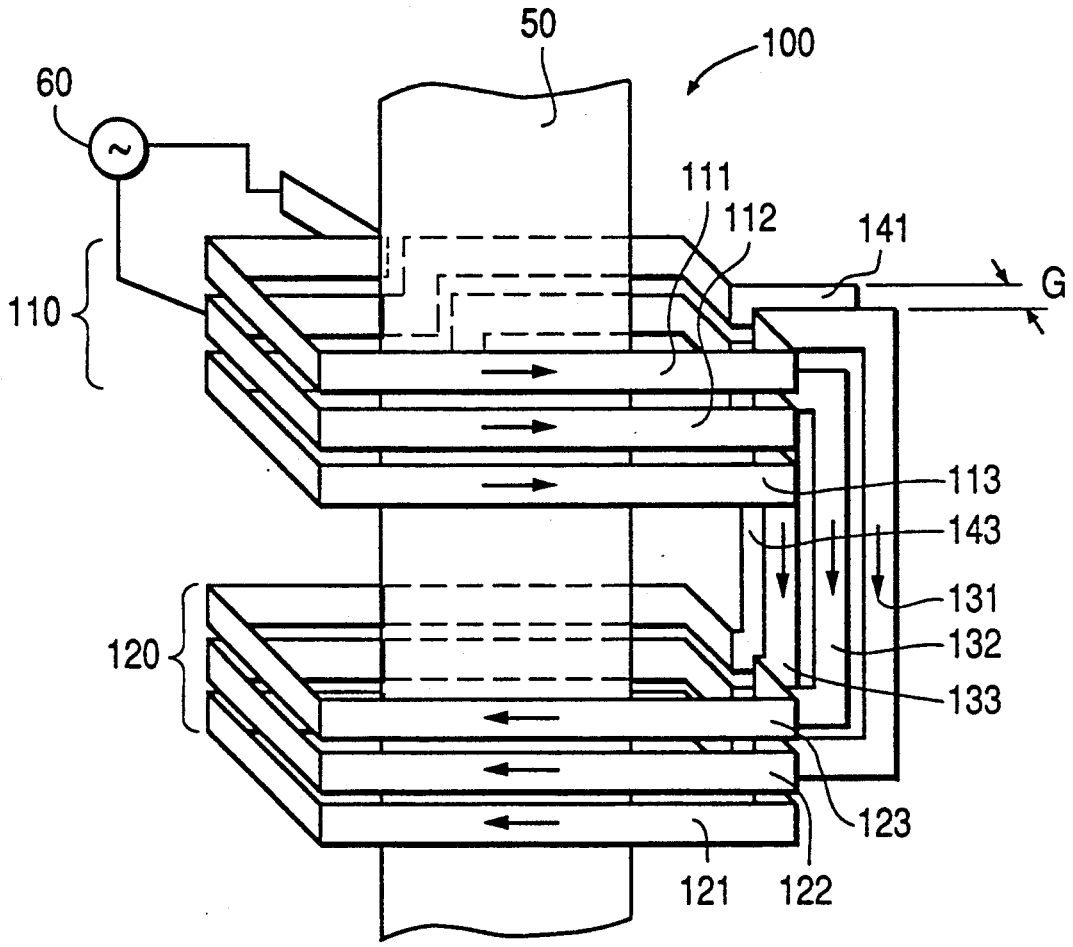
FIG. 2 is a schematic view of a first preferred embodiment of the present invention.

FIG. 2 shows a first preferred embodiment of an induction heating apparatus 100 according to the present invention. As shown in this figure, an upper coil section 110 is a 3-turn coil consisting of single turns 111, 112 and 113, and the turns 111, 112 and 113 have a discontinuity at one location. On the other hand, a lower coil section 120 is a 3-turn coil consisting of single turns 121, 122 and 123, and the respective turns 121, 122 and 123 have a discontinuity at one location. First ends (on the front side as viewed in FIG. 2) of the turns 111, 112 and 113 and first ends of the turns 121, 122 and 123 are electrically connected via connecting conductors 131, 132 and 133, respectively. Also, the other ends (on the rear side as viewed in FIG. 2) of the turns 111, 112 and 113 and the other ends of the turns 121, 122 and 123 are electrically connected via connecting conductors 141, 142 and 143 (the conductor 142 is not seen in FIG. 2), respectively. One continuous electric current passageway is formed by the above-mentioned turns 111, 112, 113, 121, 122 and 123 and connecting conductors 131, 132, 133, 141, 142 and 143. Between the connecting conductors 131, 132 and 133 and the connecting conductors 141, 142 and 143 are respectively formed gaps G having a predetermined gap length. The length of the gap G is the minimum length (20–30 mm) necessary for allowing an object to be heated (plated steel sheet) 50 to pass therethrough.

In the figure, the left-hand side of the coil sections 110 and 120 is coupled to a moving apparatus (not shown). In order to place an object 50 to be heated, such as a plated steel sheet, in the space at the central portion of the coil, under the condition where the object 50 to be heated is kept stationary, the induction heating apparatus 100 is moved rightwards as viewed in the figure. The object 50 to be heated passes through the gaps G until the object 50 to be heated is advanced into the space at the central portion of the coil. If the state shown in FIG. 2 has been realized, induction heating of the object 50 can be achieved by feeding electric power from the high-frequency power supply 60. In order to extract the object 50 from the space at the central portion of the coil, the induction heating apparatus 100 is moved leftwards as viewed in the figure until the object 50 passes through the gaps G. With the object 50 removed, maintenance and inspection of the coil can be carried out in a simple manner.

Figure 3A:
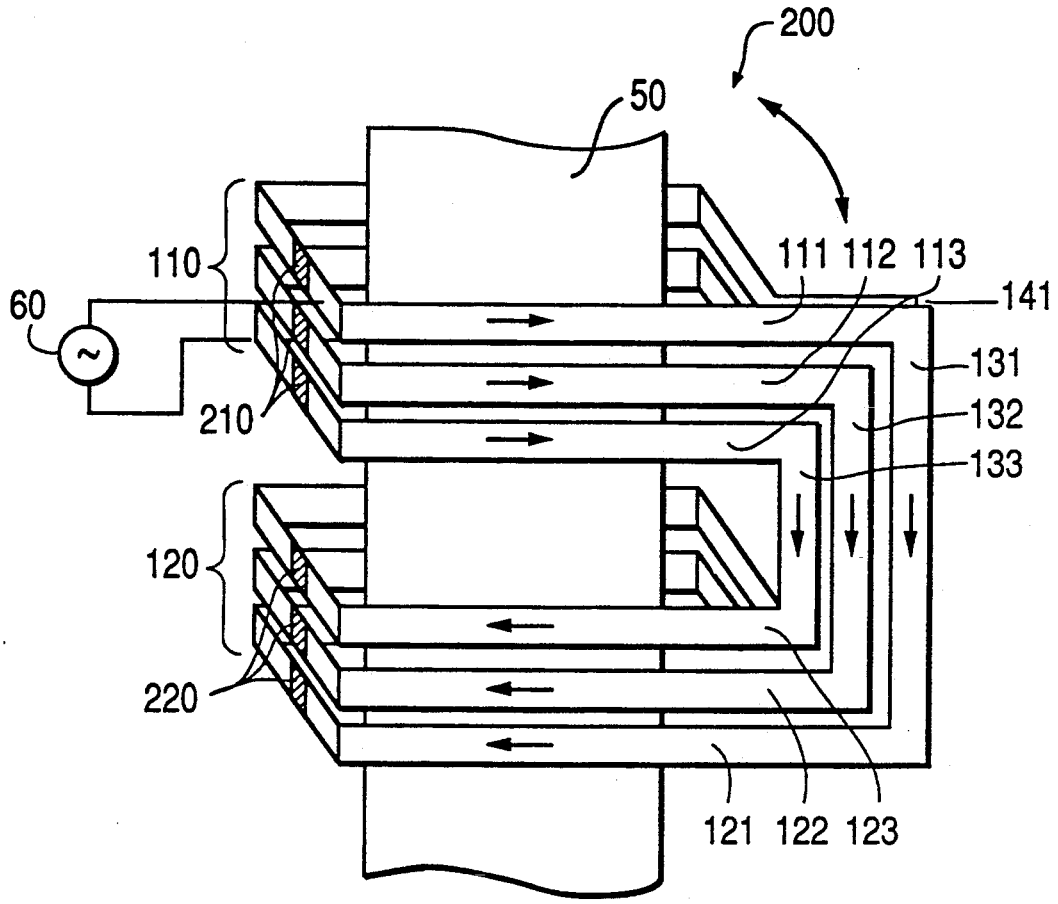
FIGS. 3(*a*) and 3(*b*) are each a schematic view of a second preferred embodiment of the present invention.
Figure 3B:
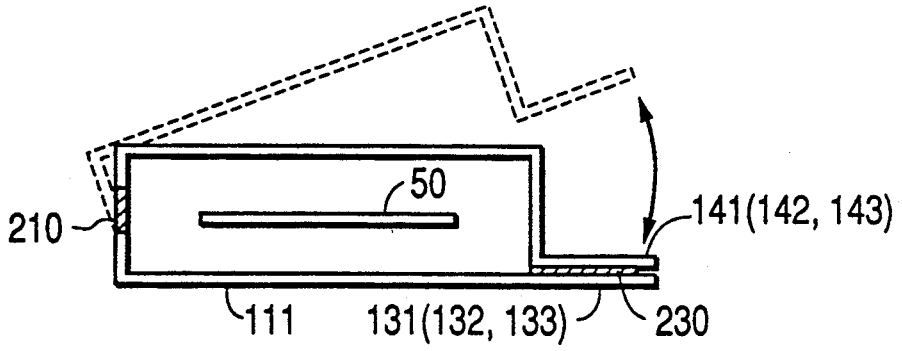
Figure 3C:
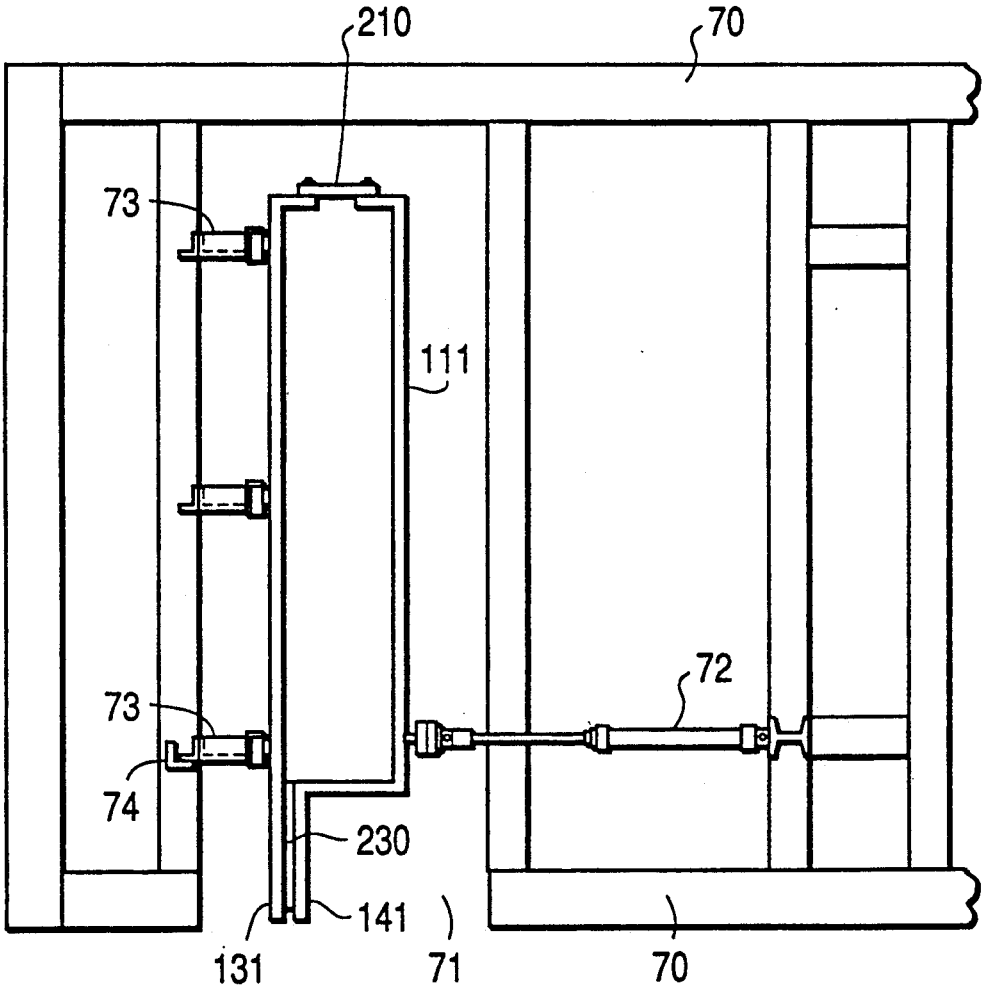
Figure 4A:
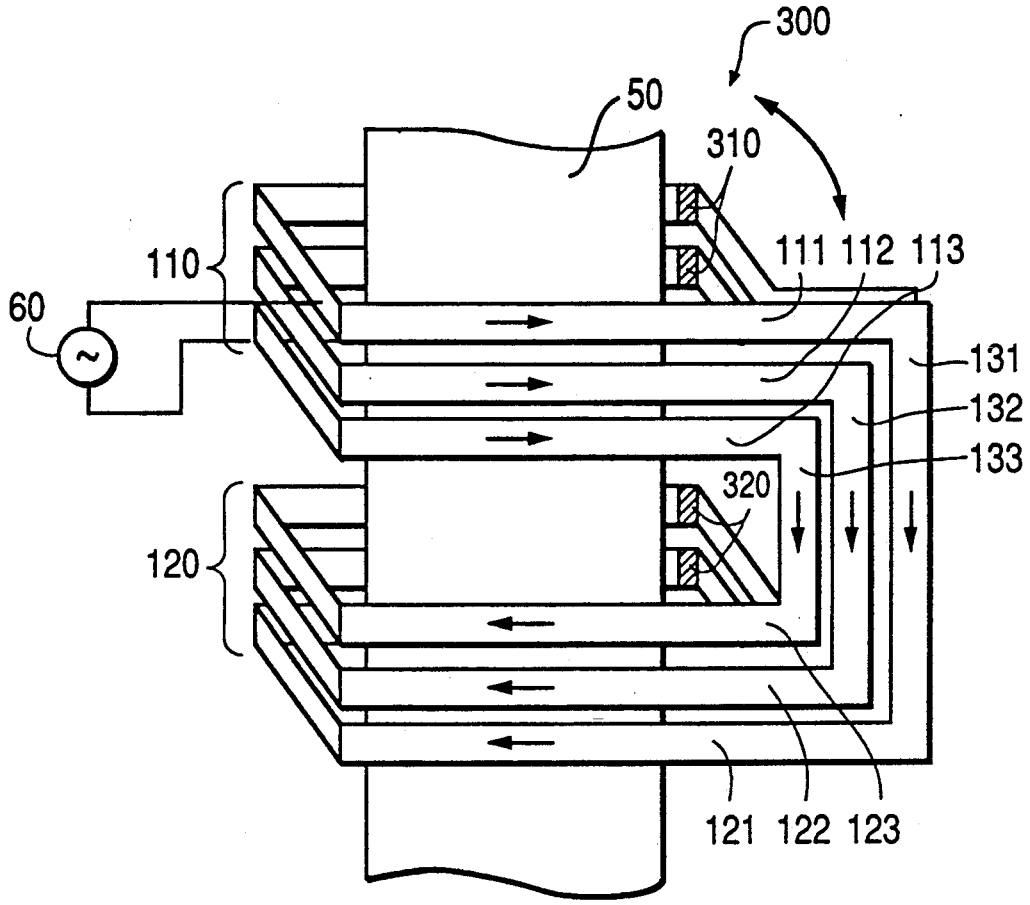
FIGS. 4(*a*) and 4(*b*) are each a schematic view of a third preferred embodiment of the present invention.
Figure 4B:
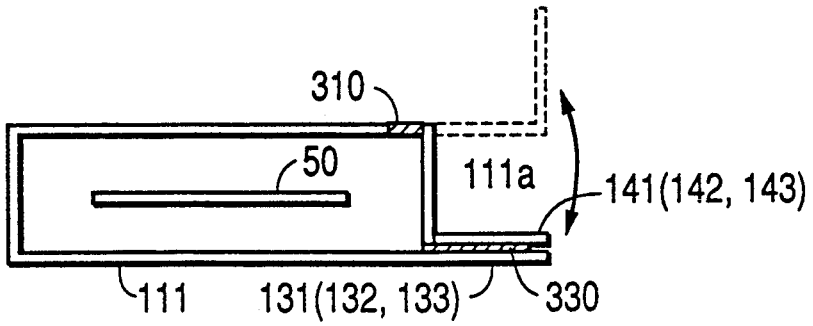
Figure 5:
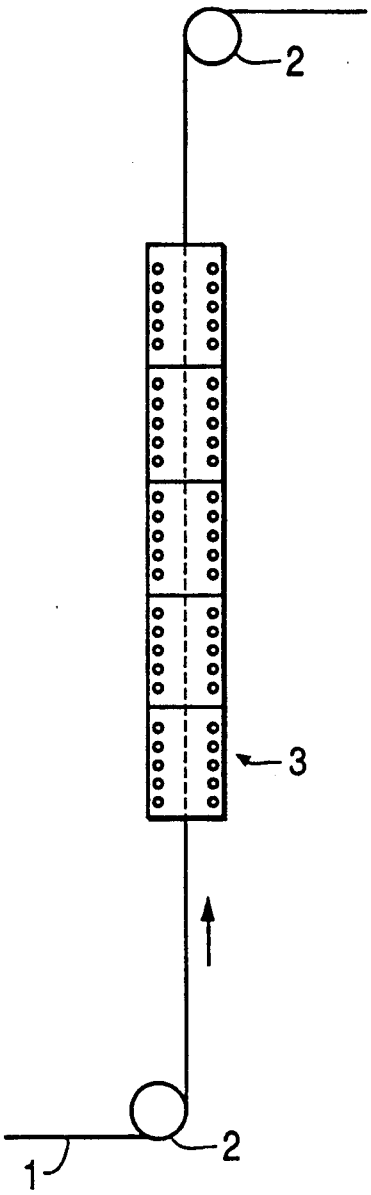
FIG. 5 PRIOR ART
FIG. 5 is a schematic view of one example of an induction heating apparatus in the prior art.
Figure 6:
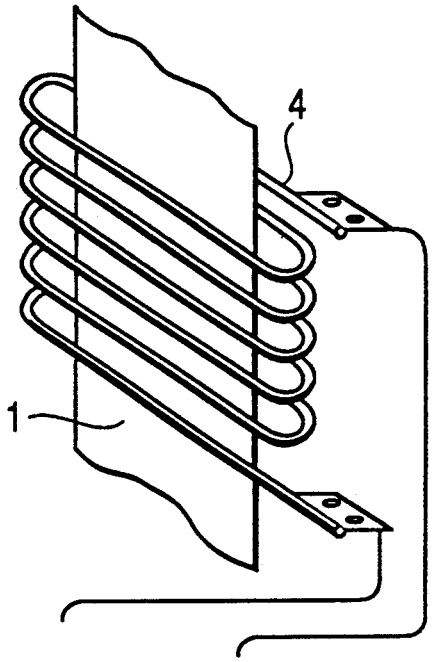
FIG. 6 PRIOR ART
FIG. 6 is a perspective view of an induction heating coil in the prior art.
Figure 7:
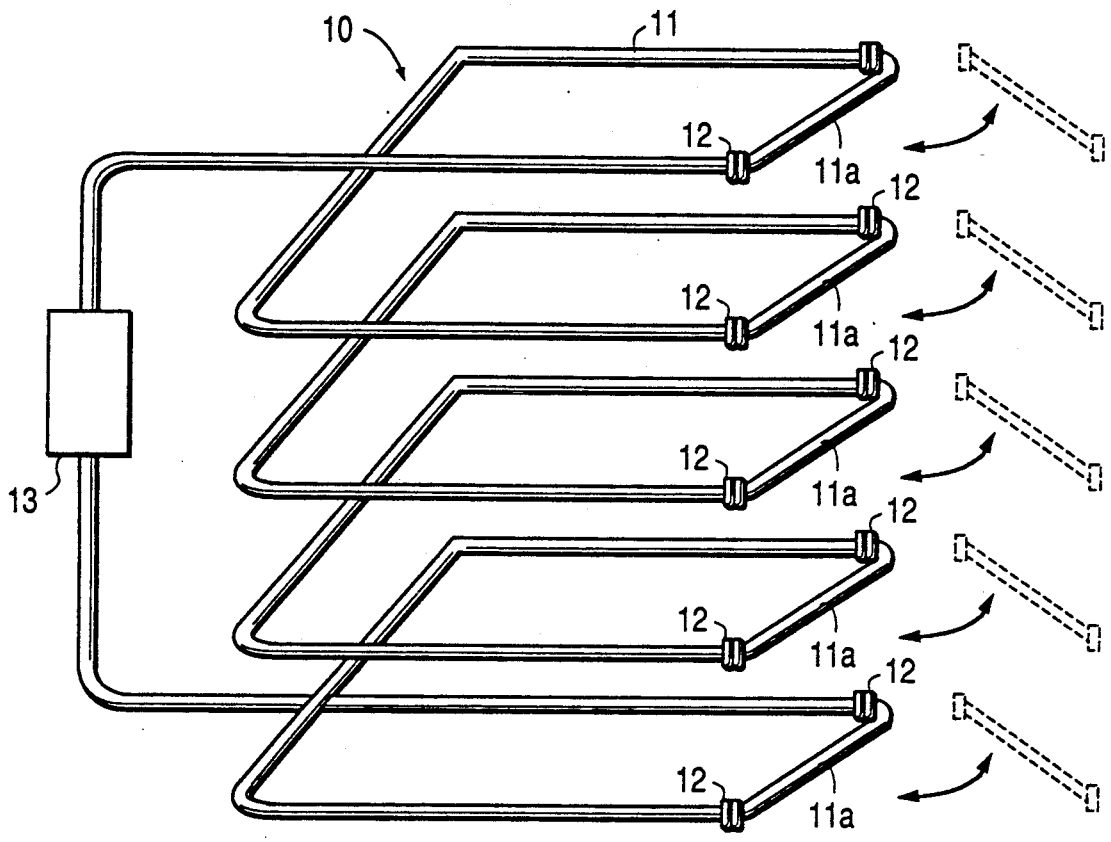
FIG. 7 PRIOR ART
FIG. 7 is a perspective view of an induction heating apparatus in the prior art.

In the above-described first preferred embodiment (FIG. 2), gaps G provide spaces through which a sheet can pass. However, due to these gaps G the impedance of the coil is slightly increased, resulting in a degradation of the heating performance of the apparatus. A second preferred embodiment (FIG. 3) or a third preferred embodiment (FIG. 4) as described in the following are free of such factor. It is to be noted that the degree of degradation of the heating performance due to the gaps G depends upon the length of the gaps G, the length of the connecting conductors, the area surrounded by one turn of the coil, and the like. In FIGS. 3 and 4, component parts providing the same functions as those in FIG. 2 are given like reference numerals, and a further explanation thereof will be omitted.

FIG. 3(*a*) is a perspective view of the second preferred embodiment, and FIG. 3(*b*) is a plan view of the same embodiment. In an induction heating apparatus 200 according to the second preferred embodiment, each of the turns 111, 112 and 113 of the coil is provided with a flexible conductor portion 210 made of a multi-layer copper belt or the like, and each of turns 121, 122 and 123 is provided with a flexible conductor portion 220 made of a multi-layer copper belt or the like. The flexible conductor portions 210 and 220 form a part of the coil and can flex.

In this induction heating apparatus 200, the coil can be opened and closed by making use of the flexible conductor portions 210 and 220 as fulcrums. When the coil closes, the connecting conductors 131, 132 and 133 oppose the connecting conductors 141, 142 and 143, respectively, with insulators 230 interposed therebetween.

When an object 50 is to be heated, the coil is opened so that the object 50 to be heated can pass through the opening. Also, if the coil is kept opened, the coil can be easily maintained and inspected. On the other hand, upon heating, the coil is closed, and the object 50 can be inductively heated by feeding electric power from a high-frequency power supply 60. Since the thickness of the insulators 240 is as very thin as about 1–2 mm, at the time of heating, degradation of a heating performance occurring at the gaps due to the insulators 230 is negligible.

One practical example of the means by which an induction heating apparatus according to the second preferred embodiment can be mounted onto a machine frame is shown in FIG. 3(*c*). FIG. 3(*c*) is a plan view of a coil and a frame supporting the coil. Side portions of turns 111, 112, 113, 121, 122 and 123 of the coil are mounted to a frame 70 via metal supports 73 and reinforcement members 74 (in FIG. 3(*c*), only the coil 111 at the uppermost level is shown). The other side portion of the same coil is coupled to a pneumatic cylinder 72 mounted to the frame 70, and a vertically extending opening 71 is formed in the frame 70 at the portion where the connecting conductors 131 and 141, the connecting conductors 132 and 142 and the connecting conductors 133 and 143 are located (in FIG. 3(*c*), only the connecting conductors 131 and 141 for the uppermost turn 111 are shown). As shown in FIG. 3(*b*), the connecting conductor 141 can be arbitrarily opened and closed with respect to the connecting conductor 131 within the opening 71 by actuating the pneumatic cylinder 72, and an object to be heated (plated steel sheet) can be easily set within the coil and extracted from the coil by making it pass through the opening 71.

FIG. 4(*a*) is a perspective view of the third preferred embodiment, and FIG. 4(*b*) is a plan view of the same embodiment. In an induction heating apparatus 300 according to the third preferred embodiment, each of turns 111, 112 and 113 of the coil is provided with a slider 310, while each of turns 121, 122 and 123 is provided with a slider 320. One part 111*a*, 112*a* and 113*a* of each of the turns 111, 112 and 113 and the connecting conductors 141, 142 and 143 can be opened and closed with respect to the connecting conductors 131, 132 and 133 by using the sliders 310 and 320 as fulcrums. When they are closed, the connecting conductors 131, 132 and 133 oppose the connecting conductors 141, 142 and 143 via thin (1–2 mm) insulators 330.

In this third preferred embodiment, similarly to the second preferred embodiment, by holding the coil in an opened state, setting of an object to be heated within the coil as well as the maintenance and inspection of the coil can be carried out easily. In the closed state, a degradation of the heating performance is negligible.

It is preferable to fabricate the coils in the above-described embodiments from hollow rectangular materials and to circulate coolant water through their interiors so as to cool the coil.

As will be obvious from the detailed description of the preferred embodiments of the present invention, the following effects and advantages are obtained.

(1) Because the apparatus is not of an opening/closing type requiring an interruption in the loop of the induction coil as well as electrical contacts, the apparatus is highly reliable and low cost.

(2) Because a gap is formed in the coil or the coil is openable and closeable, an object to be heated can be easily carried into and out of the coil. Also, the maintenance and inspection of an inner surface of the coil is easy.

(3) Owing to the fact that the direction of the current flowing through the first connecting conductor and the direction of the current flowing through the second connecting conductor are opposite to each other and the first and second connecting conductors are opposed to each other with a gap as small as possible being maintained therebetween, a lowering of the heating efficiency due to an increase in impedance caused by the gap is negligible.

While a principle of the present invention has been described above in connection with a number of preferred embodiments of the invention, it is intended that all matter contained in the above description and illustrated in the accompanying drawings be interpreted as illustrative and not in a limiting sense.

What is claimed is:

1. An induction heating apparatus comprising: a coil including a first coil section of at least one turn having a discontinuity at one location, a second coil section of at least one turn having a discontinuity at one location, a first electrical conductor electrically conductively connecting one end of each said turn of said first coil section defined at the discontinuity thereof to one end of each said turn of said second coil section defined at the discontinuity thereof, and a second electrical conductor electrically conductively connecting the other end of each said turn of said first coil section defined at the discontinuity thereof to the other end of each said turn of said second coil section defined at the discontinuity thereof, whereby one continuous electric current passageway is formed by the turns of said coil sections and said conductors, and each of said turns of the coil sections having a flexible portion between the ends thereof defined at the discontinuity; open/closing means connected to the coil for swinging respective portions of the coil relative to one another about said flexible portions of the turns of the coil sections of said coil so as to vary a distance between each said first conductor and each said second connector conductor; and a power supply connected to said coil.

2. An induction heating apparatus as claimed in claim 1, wherein each said flexible portion is a flexible electrical conductor forming an integral part of the respective turn of said coil.

3. An induction heating apparatus as claimed in claim 1, wherein each said flexible portion is a slider.

* * * * *